United States Patent [19]

Beckhusen

[11] Patent Number: 4,986,084

[45] Date of Patent: Jan. 22, 1991

[54] QUENCH EXPANSION VALVE REFRIGERATION CIRCUIT

[75] Inventor: Gerard F. Beckhusen, Liverpool, N.Y.

[73] Assignee: Carrier Corporation, New York, N.Y.

[21] Appl. No.: 208,606

[22] Filed: Jun. 20, 1988

[51] Int. Cl.[5] ..... F25B 41/04

[52] U.S. Cl. ..... 62/197; 62/217; 62/225; 62/205

[58] Field of Search ..... 62/197, 217, 225, 224, 62/208, 209, 212, 216, 222, 203, 204, 205, 196.1

[56] References Cited

U.S. PATENT DOCUMENTS

| | | | |
|---|---|---|---|
| 3,095,710 | 7/1963 | Clark | 62/197 X |
| 4,226,604 | 10/1980 | Weis | 62/197 X |
| 4,258,553 | 3/1981 | Kelly et al. | 62/197 X |
| 4,550,574 | 11/1985 | Hohman | 62/197 |
| 4,760,707 | 8/1988 | Dennis et al. | 62/197 |

*Primary Examiner*—Harry B. Tanner

[57] ABSTRACT

A refrigeration circuit is provided with a quench line connecting the liquid line and the suction line and containing a QEV. The QEV is controlled responsive to the superheat of the refrigerant supplied to the compressor. By injecting liquid refrigerant downstream of the suction modulation valve and the sensor for the TXV, the system can be operated at low capacity without overheating the compressor oil.

3 Claims, 1 Drawing Sheet

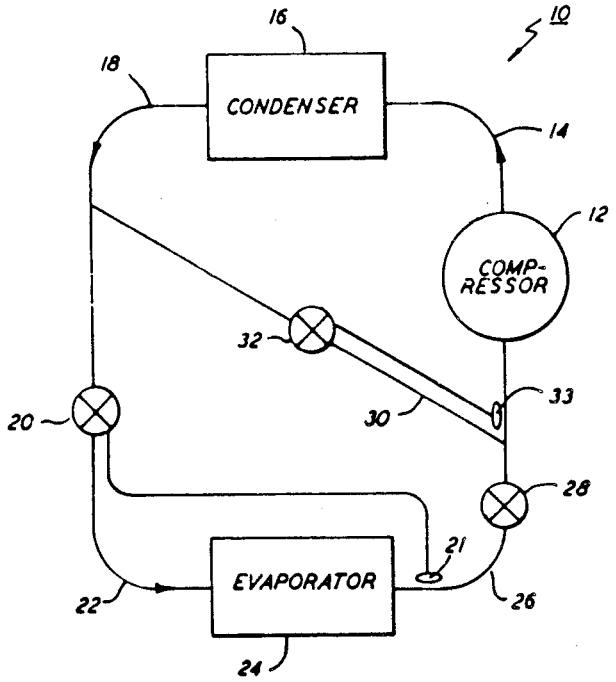
10
16
18
CONDENSER
14
12
COMP-
RESSOR
32
33
30
20
28
21
EVAPORATOR
22
26
24

QUENCH EXPANSION VALVE REFRIGERATION CIRCUIT

BACKGROUND OF THE INVENTION

Some refrigeration applications, including transport refrigeration, require operation at reduced capacity to hold product within a very narrow temperature range. In some cases suction modulation is used to reduce and regulate capacity. This affects suction and discharge temperatures. When suction modulation occurs at high ambient temperatures, the refrigerant supplied to the compressor may be too hot, absent some correcting measures, and this results in compressor discharge temperatures that are too high. If discharge temperatures are not kept from getting too hot, the compressor lubricant can break down and ultimately cause failure of the compressor.

Liquid refrigerant is often used to lower the discharge temperature by feeding it into the suction side of the compressor. One approach is to operate a solenoid valve responsive to the suction modulation valve. This approach is not responsive to ambient or any other temperature reference and can provide unwanted quench as at low ambient and low discharge temperature. Too much liquid refrigerant can also result in liquid slugging or floodback to the compressor and can ultimately cause failure of the compressor.

SUMMARY OF THE INVENTION

A quench expansion valve, QEV, is placed in the refrigerant circuit between the liquid and the suction lines. A QEV is a thermostatic expansion valve, TXV, applied in a different way. The sensing bulb for the QEV is located on the suction line near the compressor inlet. The QEV has a superheat setting which is higher than the setting of the main expansion valve so that the QEV does not perform any quenching prior to suction modulation and thereby does not affect the maximum capacity of the unit when needed. The QEV lowers the compressor discharge temperatures by controlling the compressor inlet conditions.

It is an object of the invention to provide a varying amount of quench which is supplied responsive to need.

It is an additional object of this invention to protect against excessive compressor discharge temperatures.

It is another object of this invention to avoid supplying too much liquid refrigerant to the compressor.

It is an additional object of this invention to provide a QEV which has a range of positions. These objects, and others as well become apparent hereinafter, are accomplished by the present invention.

Basically, a refrigeration circuit is provided with a quench expansion valve. The quench expansion valve is responsive to the suction temperature and controls to a predetermined, settable superheat which is set to a superheat above that of the TXV which is set for maximum capacity.

BRIEF DESCRIPTION OF THE DRAWING

For a fuller understanding of the present invention, reference should now be made to the following detailed description thereof taken in conjunction with the accompanying drawing wherein;

The FIGURE is a schematic representation of a refrigeration circuit with the quench expansion valve of the present invention.

DESCRIPTION OF THE PREFERRED EMBODIMENTS

In the FIGURE, the numeral 10 generally designates a refrigeration circuit. Refrigerant circuit 10 includes a compressor 12 which compresses suction gas to a higher temperature and pressure and delivers it via discharge line 14 to condenser 16. In the condenser 16, the hot refrigerant gas gives up heat to the condenser air thereby cooling the compressed gas and changing the state of the refrigerant from a gas to a liquid. Liquid refrigerant flows from condenser 16 via liquid line 18 to thermostatic expansion valve, TXV, 20. As the liquid refrigerant passes through the orifice of TXV 20, some of the liquid refrigerant vaporizes into a gas (flash gas). The mixture of liquid and gaseous refrigerant passes via distributor tubes 22 to the evaporator 24. Heat is absorbed by the refrigerant from the evaporator air by the balance of the liquid refrigerant causing it to vaporize in the coil of the evaporator 24. The vaporized refrigerant then flows via suction line 26 to compressor 12 to complete the fluid circuit. A suction modulation valve 28 is located in suction line 26 to control the amount of refrigerant delivered to the compressor 10 by controlling the flow in the suction line 26. The sensing bulb 21 of TXV 20 is located on suction line 26 between evaporator 24 and suction modulation valve 28 so that TXV 20 regulates the amount of refrigerant delivered to the evaporator 24 to establish a given superheat at the outlet of evaporator 24. The refrigerant circuit described so far is conventional. The present invention adds a quench line 30 connecting liquid line 18 and suction line 26 at a point between the suction modulation valve 28 and compressor 12. QEV 32 is located in the quench line 30 and has a sensing bulb 33 located on suction line 26 between the intersection of lines 30 and 26 and compressor 12.

In operation, TXV 20 is controlled responsive to the temperature in the suction line 26 sensed by bulb 21 so as to control the amount of refrigerant entering evaporator 24, and the superheat of the refrigerant leaving evaporator 24. QEV 32 is closed as long as the superheat sensed in line 26 by bulb 33 is less than a settable predetermined value of superheat which is higher than the superheat setting of TXV 20. If the superheat sensed by bulb 33 is higher than the set value, QEV 32 is opened to allow liquid refrigerant to pass from liquid line 18 to suction line 26. Because quench line 30 is connected to liquid line 18 upstream of TXV 20 and is connected to suction line 26 downstream of bulb 21 and suction modulation valve 28, the opening of QEV 32 does not upset the operation of TXV 20 or suction modulation valve 28. Also, because bulb 33 is located on suction line 26 downstream of the connection between quench line 30 and suction line 26, bulb 33 senses the suction gas as tempered by liquid injection and controls QEV 32 to reduce the superheat at the predetermined setting, when required.

The QEV 32 and TXV 20 can be the same type of valve but used in a different way. A QEV suitable for this purpose is available from Sporlan Valve Company as Thermostatic Expansion Valve IV-1-½-L2. Where suction modulation valve 28 is capable of complete closure, in the fully modulated condition, the only refrigerant supplied to compressor 12 will be the liquid refrigerant supplied via quench line 30 under the control of QEV 32.

Although a preferred embodiment of the present invention has been illustrated and described, other changes will occur to those skilled in the art. It is therefore intended that the scope of the present invention is to be limited only by the scope of the appended claims.

What is claimed is:

1. A closed refrigeration circuit containing refrigerant and serially including a compressor, a discharge line, a condenser, a liquid line, a thermal expansion valve, at least one distributor tube, an evaporator and a suction line connected to the compressor and containing suction modulation valve means;

said thermal expansion valve having sensing means for sensing superheat in said suction line upstream of said suction modulation valve means and for controlling said thermal expansion valve means responsive thereto;

a quench line connecting said liquid line to said suction line at a point in said suction line downstream of said suction modulation valve means;

a quench expansion valve in said quench line for controlling the flow of liquid refrigerant directly from said liquid line to said suction line; and sensing means for sensing superheat in said suction line downstream of the point of connection of said quench line to said suction line whereby said quench expansion valve is controlled responsive to superheat in said suction line as supplied to said compressor.

2. The circuit of claim 1 wherein said sensing means for sensing superheat in said suction line downstream of the point of connection of said quench line to said suction line controls said quench expansion valve to limit said refrigerant supplied to said compressor via said suction line to a predetermined settable superheat.

3. The circuit of claim 1 wherein said suction modulation valve means is capable of full closure whereby said quench line supplies the only refrigerant to said compressor when said compressor is fully modulated.

* * * * *